US006699087B1

(12) United States Patent
Tafoya et al.

(10) Patent No.: US 6,699,087 B1
(45) Date of Patent: Mar. 2, 2004

(54) HIGH-VOLUME, NO-DRAG SEA CHEST WITH PURGE CAPABILITY

(76) Inventors: Samuel Barran Tafoya, 135 41st Cir. E., Bradenton, FL (US) 34208; Hans Guenter Broemel, 2908 29th Ave. E., Bradenton, FL (US) 34208

( * ) Notice: Subject to any disclaimer, the term of this patent is extended or adjusted under 35 U.S.C. 154(b) by 0 days.

(21) Appl. No.: 10/394,907

(22) Filed: Mar. 21, 2003

(51) Int. Cl.[7] ..... B63H 21/10
(52) U.S. Cl. ..... 440/88 C
(58) Field of Search ..... 114/125, 121; 440/88 M, 88 C, 88 D, 46

(56) References Cited

U.S. PATENT DOCUMENTS 5,692,451 A * 12/1997 Pastore ..... 114/125

* cited by examiner

*Primary Examiner*—Ed Swinehart
(74) *Attorney, Agent, or Firm*—Dorothy S. Morse

(57) ABSTRACT

A sea chest that can provide a large volume of water substantially without drag or cavitation for cooling the inboard engines of a marine vessel. The keyhole shape through the bottom surface of the sea chest is critical to its function and causes eddys to form at its outside edges, as well as water to flow into the sea chest at the center of these edges. The present invention sea chest also has an orifice through which a quick burst of air or water can be sent to clean debris clogs and eliminate the need for manual cleaning. Present invention size and mounting location are determined by its application. Although not limited thereto, use of the present invention is generally contemplated for large and high-speed marine vessels. However the present invention can also provide benefit to smaller marine vessels, including those as small in length as twenty feet.

20 Claims, 3 Drawing Sheets

HIGH-VOLUME, NO-DRAG SEA CHEST WITH PURGE CAPABILITY

CROSS-REFERENCES TO RELATED APPLICATIONS

None.

BACKGROUND OF THE INVENTION

1. Field of the Invention

This invention relates to the field of marine sea chests, specifically to a sea chest configured for flush-mounting within the hull of a marine vessel having inboard engines to provide a large volume of sea water substantially without drag or cavitation for cooling the engines. The inlet through the bottom surface of the present invention sea chest has a critical keyhole shape that causes eddys to form at its outside edges when the marine hull into which it is mounted moves in a forwardly direction and further causes seawater to flow into the sea chest at the center of each leading edge. The present invention sea chest also has an orifice through its top surface from which a quick burst of air or water can be sent to clean debris clogs and eliminate the need for manual cleaning. Such debris removal can be performed on a voluntary basis, or as an automated response to a predetermined amount of change in monitored data, such as temperature readings. Size is not a limiting factor and the present invention sea chest can be made to any size appropriate to the vessel to which it is installed, as long as the shape of the keyhole inlet is preserved. Also, it can be mounted almost anywhere below the water line of a marine hull, but typically would be in a location near the inboard engines. Although not limited thereto, use of the present invention is generally contemplated for large and high-speed marine vessels. However the present invention sea chest can also provide benefit to other marine vessels, including those having a length dimension as small as twenty feet.

2. Description of the Related Art

One use for sea chests in the hulls of large marine vessels is to collect the seawater needed for engine cooling. Current sea chests typically have one large opening through a bottom surface for drawing in water and one or more inlet openings through an opposing top surface leading to seawater pumps. The effectiveness of a sea chest depends upon a combination of its size and the volume of seawater that can flow into it and made available to the seawater pumps for engine cooling. To keep the vegetation, garbage, and other debris often found in seawater from entering the sea chest and clogging the inlet openings of the seawater pumps, a screen or grill is generally employed )over the large opening of the sea chest. Divers are required periodically for manual cleaning of such screens and grills. In addition to the cleaning expense, many prior art sea chests seawater have scoops to collect seawater that produce a considerable drag. In contrast, the present invention provides a more efficient sea chest inlet configuration through its bottom surface that enhances seawater flow into the inlet openings leading to the seawater pumps. The present invention does not require a screen or grill covering, since it has a purge opening through its top surface that allows for a quick burst of air or water to unblock any type of debris that might be temporarily clogging it. It also has a flush mounting within the marine hull that prevents drag. Further, since no divers are required for periodic cleaning, operating costs for a marine vessel using the present invention are reduced. There is no sea chest known with a keyhole-shaped inlet opening through its bottom surface and all of the advantages of the present invention.

BRIEF SUMMARY OF THE INVENTION—OBJECTIVES AND ADVANTAGES

The primary object of this invention is to provide a sea chest that is configured and positioned to induce a large volume of seawater through the opening in its bottom surface. A further object of this invention is to provide a sea chest that draws sufficient volumes of seawater to eliminate cavitation. It is also an object of this invention to provide a sea chest that prevents drag. A further object of this invention is to provide a sea chest that is easily and cost-effectively maintained. It is also an object of this invention to provide a sea chest that can be mounted almost anywhere in a ship's hull, although preferably near to the engines. A further object of this invention is to provide a sea chest with durable construction for long-term use. It is also an objective to provide a means of cooling marine engines in the event of water pump failure during a performance run.

As described herein, properly manufactured, and installed flush with the hull of a boat or large ship, the present invention sea chest provides a large volume of seawater for the cooling of marine engines with little or no drag. The flush mounting and resulting elimination of drag reduces fuel consumption. In addition, the small size and simple design of the present invention, as compared to prior art sea chests, allows it to be mounted almost anywhere in a marine hull, although typically it would be positioned near to the engine location. The large volume of seawater flowing through the present invention sea chest is provided by the unique keyhole shape of the single inlet opening through its bottom surface, which causes the laminar flow across a forwardly moving marine hull to form eddys at the outside edges of the keyhole opening and seawater to flow into the sea chest at the center of its leading edge. The eddys that are formed on the two angular sides of the keyhole-shaped inlet redirect the inertional energy to flow upward into the sea chest, inducing the main flow of seawater to follow. The eddys are formed by the rounded edges on the bottom side of the narrow portion of the keyhole-shaped opening. The efficiency of the sea chest can be increased by use of inwardly sloping edges adjacent to the narrow portion of keyhole-shaped inlet. The rear portion of the keyhole-shaped opening, with its larger and wider dimensions, is also preferably angled on its rear topside surface to enhance upward flow and maximize efficiency of the present invention sea chest. Thus, due to the velocity of the hull as it moves in a forwardly direction, the keyhole-shaped opening prevents water from bypassing it and as long as a bypass valve is added at the pump, the present invention sea chest will continue to provide seawater for engine cooling purposes even in the event of water pump failure during an endurance run. Due to the large amount of seawater induced to flow into the keyhole-shaped inlet, cavitation is eliminated as the seawater moves through the top surface of the sea chest and upward into the inlet side of the seawater pumps, preventing steam bubbles that are low in temperature and pressure from forming. The operating cost of a marine vessel using the present invention sea chest is also reduced since it is easily and cost-effectively maintained. Instead of requiring usage of a screen or grill, and divers to periodically clean vegetation, garbage, and/or other debris there from, a quick purging burst of air or water can be forced from the orifice through the top surface of the present invention sea chest to dislodge anything clogging it. The air and water bursts can be manually performed or automatically activated in response to a predetermined amount of change in monitored data. Also, the most preferred embodiment of the present invention sea chest is attached to a collar on the inside of the hull with a large number of closely spaced-apart oversized bolts, to keep it securely attached to the hull. The use of oversized bolts, and a large number of them, increases sea chest longevity. Recessed perimeter openings through the bottom surface of the sea chest are configured and dimensioned for flush mounting of the bolts.

While the description herein provides preferred embodiments of the present invention, it should not be used to limit its scope. For example, variations of the present invention, while not shown and described herein, can also be considered within the scope of the present invention, such as variations in the perimeter and depth dimensions of the sea chest; the thickness of the collar used on the inside of the marine hull for sea chest attachment; the number, size, and type of bolts used to attach the collar and sea chest in their usable positions against the marine hull; the type of sealant used between the collar, sea chest, and hull; the size of the purge orifice through the top surface of the sea chest; and the length and width dimensions of the single keyhole opening through the bottom surface of the sea chest although such dimensions must remain in proportion when elongated to substantially preserve the keyhole configuration for maximum efficiency during use. Thus, the scope of the present invention should be determined by the appended claims and their legal equivalents, rather than being limited to the examples given.

DETAILED DESCRIPTION OF THE INVENTION

Figure 3:
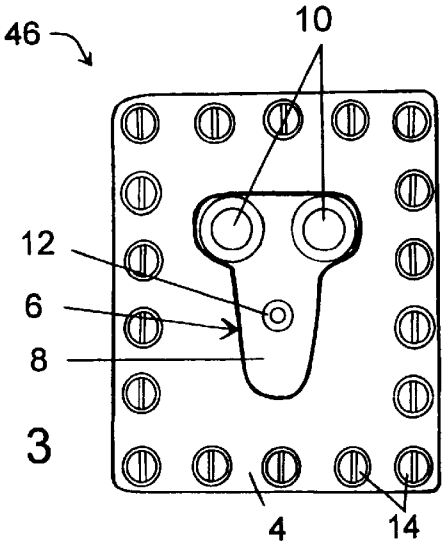
FIG. 3 is a bottom view of a second preferred embodiment of the present invention sea chest having two inlet openings through its top surface that are larger than those shown in FIG. 1.

FIGS. 1–8 illustrate the most preferred embodiments of the present sea chest invention, to specifically include first preferred embodiment 2 and second preferred embodiment 46, all of which provide a large volume of seawater flow 32 for cooling of the inboard engines of a marine vessel (not shown in its entirety) substantially without drag or cavitation. The flush mounting of the bottom surface 4 of the present sea chest invention within a recessed opening 16 in a marine hull 30, and resulting elimination of drag, reduces fuel consumption. The operating cost of a marine vessel using the present sea chest invention is also reduced since it is easily and cost-effectively maintained via its purge/cleaning orifice 12. Size is not a limiting factor for the present sea chest invention and although it is generally contemplated for use on large and high-speed marine vessels, the potential for small size and its simple design allow it to be mounted almost anywhere on a marine hull 30 near the engine location (not shown), even on marine vessels having a length dimension as small as twenty feet. The large volume of seawater flow 32 is provided by the unique shape of its single large keyhole opening 6, which causes the laminar flow across a forwardly moving marine hull 30 to form eddys 34 at the outside edges of keyhole opening 6 and the seawater flow 32 to pass through the bottom surface 4 of the present sea chest invention at the center 44 of leading edges 42 in its keyhole opening 6. Leading edges 42 preferably have an inwardly sloping configuration to increase sea chest efficiency. Due to the large volume of seawater flow 32, cavitation is eliminated as the seawater moves upward into the inlet side of the seawater pumps, preventing low pressure and temperature steam bubbles from forming. Instead of requiring the usage of a screen or grill, and divers to periodically clean vegetation, garbage, and/or other debris there from, a quick purging burst of air or water can be forced through purge/cleaning orifice 12 located centrally through the top surface 8 of the present sea chest invention. The burst travels through the interior of the present sea chest invention to dislodge debris clogs (nor shown) therein, as well as those blocking seawater entry through keyhole opening 6 to eliminate the need for manual cleaning. Such debris removal can be performed on a voluntary basis, or as an automated response to a predetermined amount of change in monitored data, such as temperature readings. Also, the present sea chest invention is attached at its perimeter to a collar 18 positioned on the inside of the marine hull 30 with a large number of oversized bolts 14, to keep it securely fixed within hull 30. Use of bolts 14 that are oversized, and a large number thereof in a closely spaced-apart configuration, increases the longevity of the present sea chest invention.

Figure 1:
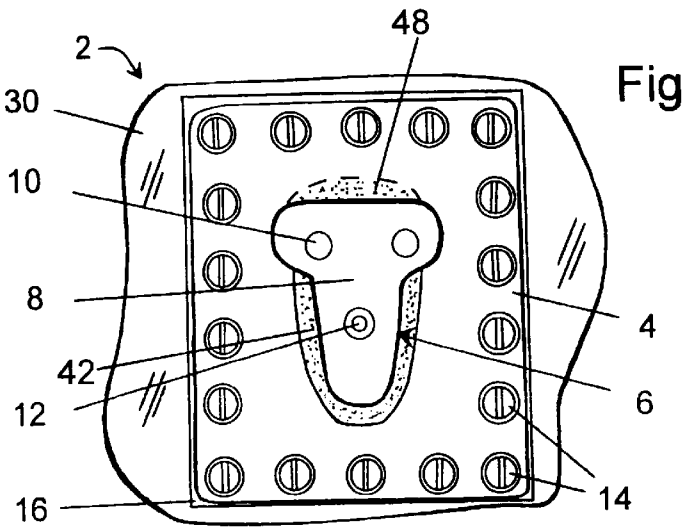
FIG. 1 is a bottom view, as installed, of the most preferred embodiment of the present invention sea chest having a single keyhole-shaped inlet opening through its substantially rectangular bottom surface, two spaced-apart inlet openings through its top surface and being positioned above the wider end of the keyhole opening with each such top surface inlet opening leading to the inlet side of seawater pumps, a purge/cleaning orifice also through its top surface and located centrally above the keyhole opening, a plurality of bolts around the sea chest perimeter, and the sea chest being mounted flush within an opening in a marine hull, with the shaded areas around the keyhole-shaped opening indicating inwardly sloping edges.

FIGS. 1 and 3 respectively show a first preferred embodiment 2 and a second preferred embodiment 46 of the present sea chest invention having one large keyhole-shaped opening 6 through its bottom surface 4. One difference between the two illustrations is that the inlet openings 10 through the present invention's top surface 8 in the second preferred embodiment 46 shown in FIG. 3 are larger than those shown in FIG. 1. Also, marine hull 30 is missing from FIG. 3, as is the shaded inward sloping configuration of the leading edges 42 adjacent to the narrow end of keyhole-shaped opening 6 and the angled rear topside surface 48 adjacent to the wider end of keyhole-shaped opening 6. With its sloping configurations of leading edges 42 and rear topside surface 48 shown in FIG. 1, first preferred embodiment 2 has a greater operating efficiency than the second preferred embodiment 46 having no sloping edges, as shown in FIG. 3. Inlet openings 10 are shown in their respective illustrations located above the trailing wider end of a keyhole-shaped opening 6. It is the configuration and dimension of the keyhole-shaped opening 6 relative to bottom surface 4 that is critical to the present invention and causes the formation of the eddys 34 at the outside/leading edges. (shown in FIGS. 7 and 8 by the number 42) of keyhole-shaped opening 6, which are responsible for inducing a high-volume of seawater flow (such as that indicated by the number 32 in FIG. 5) into all embodiments of the present invention, including first preferred embodiment 2 and second preferred embodiment 46, at the center portion of leading edges 42 and through the interior cavity toward inlet openings 10, the center portion of leading edges 42 being shown in FIGS. 7 and 8 by the number 44. When the marine hull 30 into which the present invention sea chest is installed is moving in a forwardly direction, the eddys 34 that are formed on the two angular sides of the keyhole-shaped inlet redirect the inertional energy to flow upward into the sea chest, inducing the main flow of sea water 32 to follow. The eddys 34 are formed by the rounded edges on the bottom side of the narrow portion of keyhole-shaped opening 6. The efficiency of the present sea chest invention is increased by use of inwardly sloping leading edges 42 adjacent to the narrow portion of keyhole-shaped opening 6. The rear portion of keyhole-shaped opening 6, with its larger and wider dimensions, also preferably has an angled rear topside surface 48 configured to further enhance upward flow and increase efficiency of the present invention sea chest over use of inwardly sloping leading edges 42 alone. Thus, due to the velocity of marine hull 30 as it moves in a forwardly direction, keyhole-shaped opening 6 prevents seawater 32 from bypassing it and as long as a bypass valve (not shown) is added at the pump, the present invention sea chest will continue to provide seawater 32 for engine cooling purposes even in the event of water pump failure during an endurance run. The present sea chest invention is shown in FIGS. 1 and 3 to have a rectangular perimeter configuration. However, its perimeter configuration is not limited thereto, even though a rectangular configuration may be preferred for ease and efficiency of installation. The present sea chest invention can be mounted anywhere on marine hull 30 under the water line, however, to minimize the amount of conduit (not shown) needed for transport of the collected seawater to the seawater pumps, it is contemplated that one or more present invention sea chests be flush-mounted to hull 30 near to the marine engines needing the cooling benefit of the collected seawater. The size of the first preferred embodiments 2 used is also not critical, as long as each is proportioned to the size of the marine hull 30 to which it is attached, the amount of seawater required for marine engine cooling, and the number of other present sea chest inventions also providing seawater for marine engine cooling. Also, as the size of the present invention sea chest changes, the keyhole-shaped opening always substantially remains in the configuration shown in FIGS. 1, 3, 7, and 8. FIG. 1 shows each inlet opening 10 in first referred embodiment 2 located at a spaced-apart distance from the other above the wide end of keyhole-shaped opening 6 and positioned to lead to the inlet side of seawater pumps (not shown). It is considered within the scope of the present invention for larger present sea chest inventions 2 to have more than two inlet openings 10, as long as each is visible through the wider end of keyhole-shaped opening 6 and they are collectively able to take in the amount of seawater needed for engine cooling without cavitation. Also, as long as the positioning relative to keyhole-shaped opening 6 and the aforesaid functional requirements for engine cooling are met, the size, number, and configuration of inlet openings 10 are not limited to that shown in FIG. 1 and FIG. 3. Inlet openings 10, should be visible through the wider end of keyhole-shaped opening 6 to achieve high volume water flow therethrough. In addition, FIGS. 1 and 3 show first preferred embodiment 2 and second preferred embodiment 46 each having a purge/cleaning orifice 12 located through its top surface 8 and positioned centrally above keyhole-shaped opening 6. Purge/cleaning orifice 12 is configured to allow for a sufficiently strong blast of air or water to be sent therethrough for unblocking vegetation, other marine life, and debris that accumulates in and around the present sea chest invention and its keyhole-shaped opening 6. Although not shown, the blast of air or water can be manually activated, repeated as often as needed, and made of varying durations. In the alternative, blasts of air or water can be automatically activated in response to a predetermined amount of change in monitored data, such as but not limited to temperature readings. The positioning of inlet openings 10 relative to keyhole-shaped opening 6, as well as the shape of keyhole opening 6, the substantially centered positioning of keyhole-shaped opening 6 through bottom surface 4 when installed, and the substantially centered positioning of purge/cleaning orifice 12 relative to keyhole-shaped opening 6 are critical to the effective operation of the present sea chest invention to provide a high volume of cooling water flow without cavitation, and all should be formed and positioned substantially as shown in FIG. 1. Consequently, little variation in component positioning for second preferred embodiment 46 shown in FIG. 3, to preserve a high level of operational efficiency. FIGS. 1 and 3 further show many spaced-apart bolts 14 around the perimeter of bottom surface 4, with FIG. 1 showing bottom surface 4 mounted flush within a recessed opening 16 in a marine hull 30. The recessed openings within which each bolt 14 is shown are not marked in FIGS. 1 and 3, however in FIGS. 7 and 8 they are clearly shown and identified by the number 40. Although the rectangular configuration shown in FIGS. 1 and 3 for bottom surface 4 is not critical, and it theoretically could have any shape, it is critical that the shape and dimension of bottom surface 4 and that of the recessed opening 16 through hull 30 closely correspond to one another. When a large number of bolts 14 are used, and in addition when bolts 14 are oversized, they increase the longevity of the present sea chest invention. Although not shown, it is contemplated for a sealant to be used between bottom surface 4 and hull 30 to prevent seawater flow 34 from being diverted from keyhole-shaped opening 6 and instead entering marine hull 30. All components of the present sea chest invention, to include bottom surface 4, top surface 8, bolts 14, and any nuts 26 or washers 28 needed to secure bolts 14, should be made from durable and corrosion-resistant materials such as but not limited to stainless steel. Carbon fiber is another material contemplated for bottom surface 4, top surface 8, and collar 18.

Figure 2:
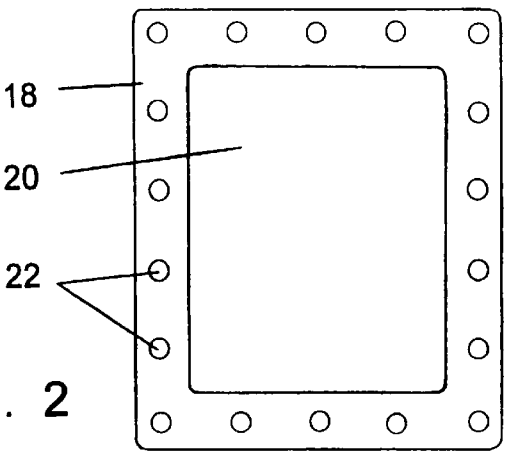
FIG. 2 is a bottom view of the most preferred embodiment of the present invention collar used on the inside of a marine hull to securely hold the sea chest in its usable flush-mounted position within the hull, with the collar having a large and substantially rectangular central opening, as well as a plurality of smaller spaced-apart openings through its perimeter each configured for the insertion therethrough of a bolt.

FIG. 2 shows the most preferred embodiment of the present invention collar 18 used on the inside of a marine hull 30 to securely hold all preferred embodiments of the present invention sea chest, including first preferred embodiment 2 and second preferred embodiment 46, in their usable positions. FIG. 2 shows collar 18 having a plurality of spaced-apart fastener openings 22 through its perimeter, with each fastener opening 22 configured for the insertion therethrough of one bolt 14. Although the collar 18 shown in FIG. 2 is not drawn in exact proportion to the first preferred embodiment 2 shown in FIG. 1 and the second preferred embodiment 46 shown in FIG. 3, it is contemplated for fastener openings 22 to be aligned with the positioning of the bolts 14 shown in FIGS. 1 and 3, and for the central collar opening 20 to be slightly larger than the perimeter dimension of corresponding bottom surface 4 of the first preferred embodiment 2, the second embodiment 46, or other embodiment used (not shown). Thus, in any embodiment of the present sea chest invention where bottom surface 4 has a different number of recessed openings 40 from that shown in FIGS. 7 and 8, the collar 18 used to secure it to marine hull 30 would have a corresponding number of identically spaced apart fastener openings 22 through its perimeter. The thickness dimension of collar 18 should be sufficient for it to have the needed strength to securely attach the embodiment of the present sea chest invention used to marine hull 30 within recessed opening 16. Collar 18 should also be made from durable and corrosion-resistant materials, such as but not limited to stainless steel, carbon fiber, or bronze, and be connected to bottom surface 4 of the present sea chest invention with fasteners, such as but not limited to bolts 14, nuts 26, and washers 28, that are also made from durable and corrosion-resistant materials.

Figure 4:
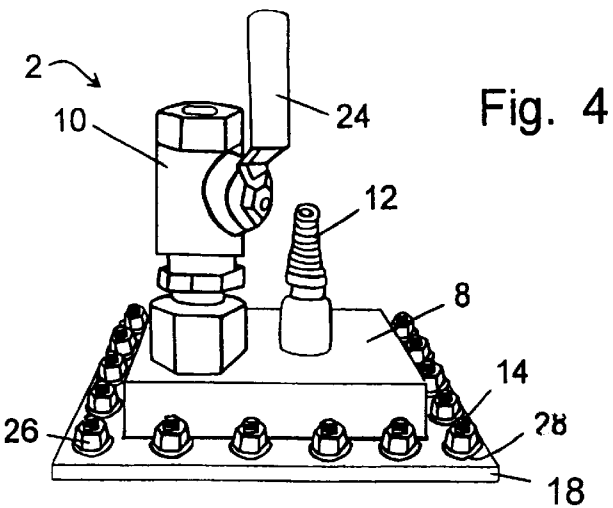
FIG. 4 is a perspective view of the top surface of the most preferred embodiment of the present invention sea chest being secured through a collar with bolts, nuts, and washers, with one of the inlet openings being visible and shown extending beyond the top surface of the sea chest, and the purge/cleaning orifice being shown adjacent to the inlet opening.

FIG. 4 shows the first preferred embodiment 2 of the present sea chest invention attached to a collar 18 with bolts 14, nuts 26, and washers 28, as well as one inlet opening 10 having a shut-off valve handle 24 and a purge/cleaning orifice 12 through top surface 8. The configuration of the portions of inlet opening 10 and purge/cleaning orifice 12 extending beyond top surface 8 is not critical and according to the intended application may differ from that shown in FIG. 4. The perimeter dimension of top surface 8 is shown in FIG. 4 to be slightly smaller than the central opening (marked by the number 20 in FIG. 2) through collar 18. It is contemplated for the scope of the present sea chest invention to include sturdy fastening means other than bolts 14 to be used for connecting bottom surface 4 and collar 18 to marine hull 30. Further, when bolts 14, nuts 26, and washers 28 are used for such connection, the number of each used may vary from that shown in FIG. 4. In addition, it is preferred for bolts 14, and any nuts 26 or washers 28 needed to secure bolts 14, to be made from durable and corrosion-resistant materials, such as but not limited to stainless steel, and for bolts 14 to be numerous and oversized so as to increase the longevity of the present sea chest invention.

Figure 5:
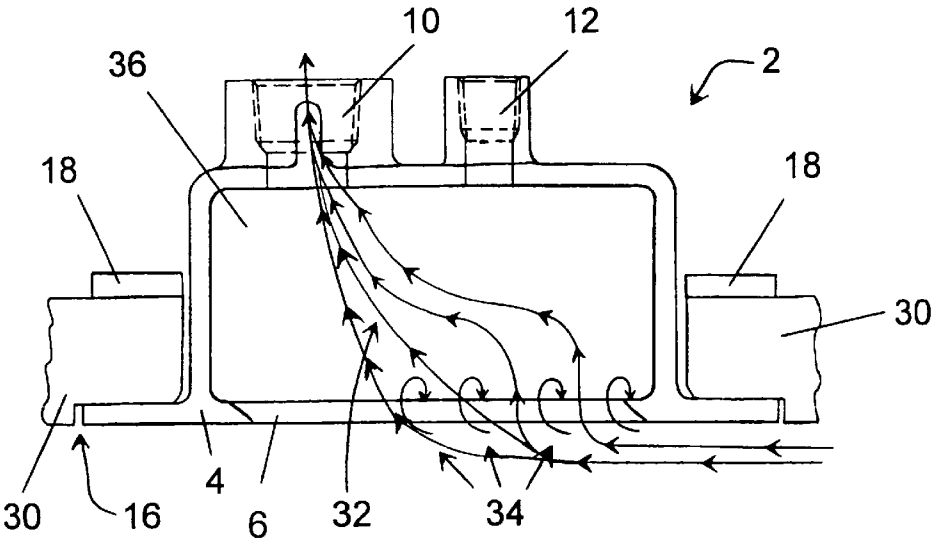
FIG. 5 is a sectional top view of the most preferred embodiment of the present invention sea chest positioned within a marine hull, with the purge/cleaning orifice and one inlet opening through the top surface of the sea chest being visible, and also with arrows showing eddy formation and seawater flow toward the inlet openings leading to the inlet side of seawater pumps.
Figure 6:
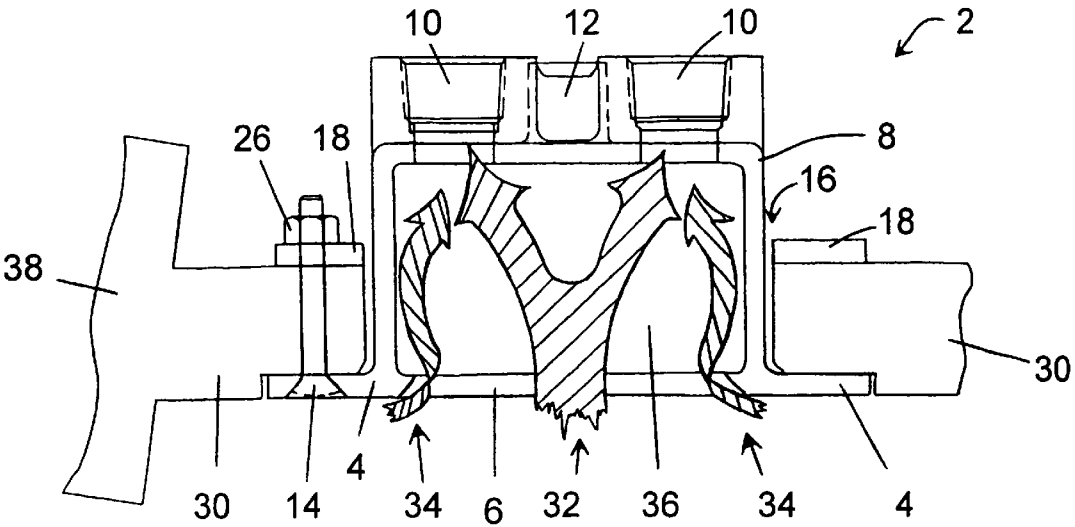
FIG. 6 is a sectional side view of the most preferred embodiment of the present invention sea chest attached to a marine hull near to its keel, with the purge/cleaning orifice and both inlet openings visible through the top surface of the sea chest, and also with arrows showing eddy formation and seawater flow toward the inlet openings of the seawater pumps.

FIGS. 5 and 6 show the first preferred embodiment 2 of the present sea chest invention positioned within a recessed opening 16 in a marine hull 30, with purge/cleaning orifice 12 and arrows showing eddy formation 34 and seawater flow 32 moving toward inlet openings 10 that lead to the inlet side of seawater pumps (not shown). In addition, FIG. 6 shows mounting of first preferred embodiment 2 with a washer 28, nut 26, and bolt 14 near to keel 38. In comparing FIGS. 5 and 6 to FIGS. 7 and 8, eddy formation 34 is shown via arrows to be at the outside/leading edge of the keyhole-shaped opening 6 through bottom surface 4 (in FIGS. 7 and 8 the inwardly sloped outside/leading edges of keyhole-shaped opening 6 are marked with the number 42), which are responsible for the high-volume of seawater flow (such as that indicated by the number 32 in FIG. 5) being drawn into the present sea chest invention at the center portion of leading edges 42 and through its interior cavity, (the center portion of leading edges 42 being shown in FIGS. 7 and 8 by the number 44). As can be seen in FIGS. 5–8, seawater flow 32 bypasses purge/cleaning orifice 12 and is directed primarily through inlet openings 10. The high volume flow of seawater through the present sea chest invention during forward movement of marine hull 30 is a direct result of the configuration of the inwardly sloping outside/leading edges of keyhole-shaped opening 6. In FIGS. 5 and 6, the bottom surface 4 of the present sea chest invention is shown to laterally extend beyond the perimeter dimension of top surface 8. It is the extension of bottom surface 4 that is used in combination with collar 18 to provide a secure connection of the present sea chest invention within the recessed portion of the opening 16 in marine hull 30. Such extension also provides a surface for the application of sealant (not shown). Although two inlet openings 10 are shown in FIG. 6, only one inlet opening 10 is shown in FIG. 5, with the second inlet opening 10 being hidden from view behind the visible inlet opening 10.

Figure 8:
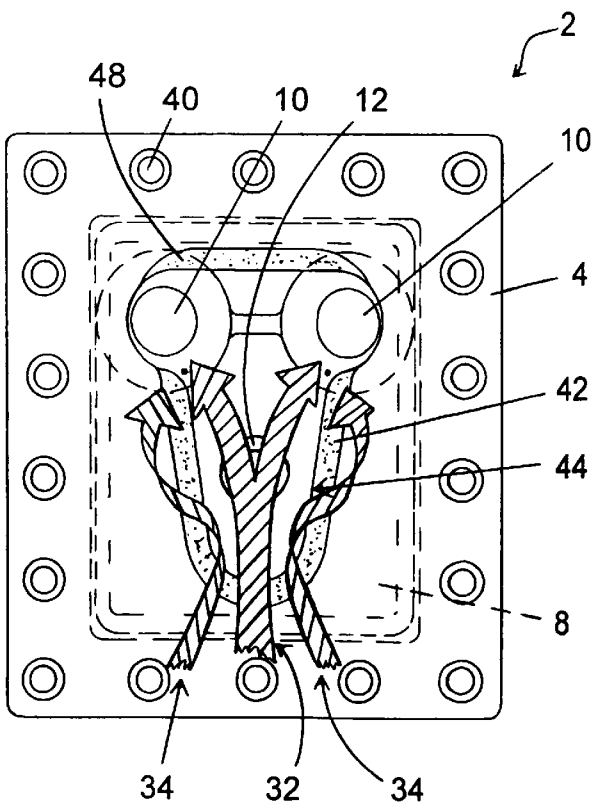
FIG. 8 is a bottom view of the most preferred embodiment of the present invention sea chest similar to that in FIG. 7, with the addition of broken lines showing hidden surfaces and features, and the shaded areas around the keyhole-shaped opening indicating inwardly sloping edges.
Figure 7:
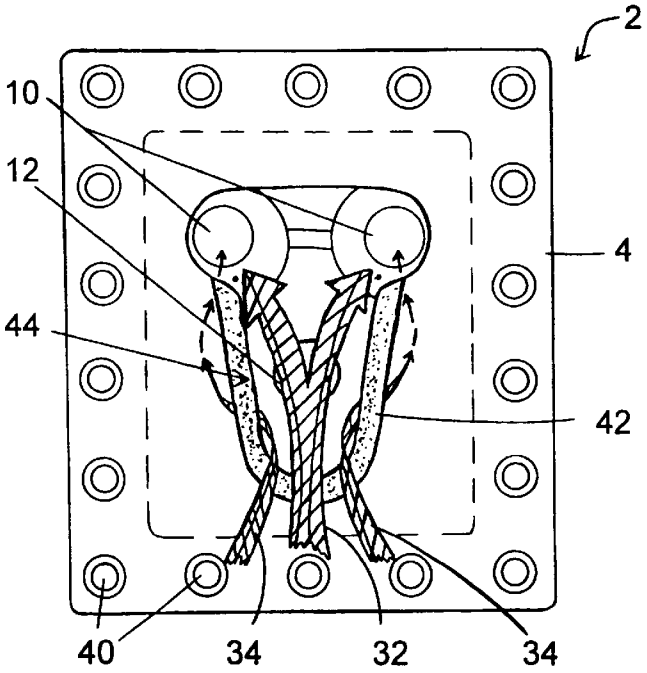
FIG. 7 is a bottom view as installed of the most preferred embodiment of the present invention sea chest having a single keyhole-shaped opening through its bottom surface, two inlet openings through the top surface of the sea chest and located above the wide end of the keyhole opening with such inlet openings leading to the inlet side of seawater pumps, a purge/cleaning orifice also located through the top surface of the sea chest and positioned centrally above the keyhole opening, arrows showing eddy formation and seawater flow toward the inlet openings leading to the inlet side of seawater pumps, and a plurality of recessed openings around the sea chest perimeter configured for recessed attachment of bolts, with the shaded area around the keyhole-shaped opening indicating inwardly sloping edges.

FIGS. 7 and 8 show first preferred embodiment 2 of the present sea chest invention having its critical keyhole-shaped opening 6 through bottom surface 4, with FIG. 7 devoid of broken lines, other than those forming the ends of the arrows showing eddy formation 34 that show travel of seawater to inlet openings 10, thus more clearly showing the relation of eddy formation 34 and seawater flow 32 relative to keyhole-shaped opening 6. FIGS. 7 and 8 also show two inlet openings 10 positioned above the wider end of keyhole opening 6, each visible through keyhole-shaped opening 6, and each leading to the inlet side of seawater pumps (not shown). In addition, FIGS. 7 and 8 show a purge/cleaning orifice 12 located centrally above keyhole-shaped opening 6, arrows showing eddy formation 34 and seawater flow 32 toward the inlet openings 10 leading to the inlet side of seawater pumps, and a plurality of recessed openings 40 around the perimeter of bottom surface 4 that are each configured for recessed attachment of a bolt 14, or other fastener (not shown). It is contemplated for openings 40 to be sufficiently recessed for the flush mounting of fasteners such as bolts 14 to eliminate drag and thereby boost marine engine fuel efficiency. FIG. 8 further has broken lines showing top surface 8 and angled rear topside surface 48. Shaded areas around the keyhole-shaped opening indicate the preferably used inwardly sloping edges associated with leading edge 42 and angled rear topside surface 48.

To use the present invention sea chest, including first preferred embodiment 2 and second preferred embodiment 46, one would first make an opening within a marine hull 30 that is slightly larger than top surface 8, with a recessed portion adjacent thereto having a depth corresponding to the thickness of bottom surface 4, as well as a perimeter dimension corresponding to the amount that bottom surface 4 extends beyond top surface 8, so that bottom surface 4 can be mounted flush with marine hull 30 to eliminate drag. The present sea chest invention can be any size that is appropriate to the marine hull 30 into which it is to be secured and mounted almost anywhere below its water line, however, typically the present sea chest invention would be placed in a location near to the marine engines (not shown) for which it is to provide seawater flow 32. Openings 40 through the perimeter of bottom surface 4 also have a recessed configuration so that the top of the fasteners inserted therethrough, such as bolts 14, will be mounted flush with bottom surface 4. Bolts 14, or other fasteners used through recessed openings 40, are preferably oversized, closely spaced apart, plentiful in number, and made from corrosion-resistant material, to promote longevity of the present invention sea chest. Prior to securing bottom surface 4 within the recessed opening 16 of hull 30, although not shown, marine quality adhesive or other sealant is typically used between bottom surface 4 and the recessed portion of opening 16, as well as between collar 18 and hull 30, to make certain that all seawater 32 passing beyond hull 30 is directed into the present sea chest invention and through inlet openings 10. As installation occurs, the present sea chest invention must be oriented with the narrower end of its keyhole-shaped opening 6 in the direction of forward travel of the marine vessel within which it is mounted to be effective, and manually held in position against hull 30 within recessed opening 16. Collar 18 is then placed on the inside of hull 30 with its fastener openings 22 each aligned with one of the recessed openings 40 through bottom surface 4. Although not shown, holes corresponding in position to fastener openings 22 in collar 18 can be predrilled through hull 30 for faster installation. Thereafter, bolts 14 or other fasteners are each inserted through a different one of the recessed openings 40, a preformed/predrilled hole in the recessed portion of opening 16, subsequently extended through the corresponding one of the fastener openings 22 in collar 18, and secured with one or more nuts 26 and/or washers 28. When the marine vessel (not shown) within which the present sea chest invention is mounted requires seawater flow 32 for cooling its engines, shut-off valves such as that controlled by the shut-off valve handle 24 in FIG. 4 and which communicate with inlet openings 10, can be opened to permit seawater flow 32 therethrough. Although not shown, manual and automated opening of the shut off valves is contemplated. During forwardly movement of marine hull 30, the configuration of keyhole-shaped opening 6 creates eddys 34 at its inwardly sloping outside/leading edges 42 and a large volume of seawater flow 32 to enter the bottom surface 4 of the present sea chest invention at the center 44 of outside/leading edges 42. Due to such large volume of seawater flow 32, cavitation is eliminated. Should vegetation, marine life, garbage, and/or other debris accumulate in or around the present sea chest invention or keyhole-shaped opening 6, and block the flow of seawater 32 therethrough, a quick burst of air or water can be forced through purge/cleaning orifice 12 located centrally through the top surface 8 of the present sea chest invention, and thereafter through the interior of the present sea chest invention to dislodge debris clogs (not shown) and eliminate the need for manual cleaning or use of a screen or grate. Such debris removal can be performed on a voluntary basis, or as an automated response to a predetermined amount of change in monitored data, such as but not limited to temperature readings (not shown). Use of the present sea chest invention is generally contemplated for large and high-speed marine vessels, however it can also provide benefit to other marine vessels, including those having a length dimension as small as twenty feet.

We claim:

1. A sea chest that can be flush-mounted through use of a collar within a recessed opening in the hull of a marine vessel below its waterline to provide a large volume of water substantially without drag or cavitation for cooling the inboard engines of the marine vessel, said sea chest comprising:

a chest with a substantially hollow interior, a bottom surface with a perimeter, and an opposing top surface;

a keyhole-shaped opening through said bottom surface, said keyhole-shaped opening having a wider end and being configured with outside edges designed to cause eddys to form and seawater to flow into said hollow interior at the center portion of said outside edges;

a plurality of recessed apertures through said bottom surface adjacent to said perimeter;

inlet opening means through said top surface that leads to the inlet side of the marine engines requiring cooling;

an orifice through said top surface;

activation means adapted for repeatedly sending purging bursts of fluid from said orifice and through said hollow interior; and fastening means adapted for secure flush-mounted connection of said bottom surface of said chest to a marine hull via use of a recessed opening in the marine hull and also to a collar positioned against the inside of the hull having fastener openings therethrough that correspond in positioning to said recessed openings through said bottom surface, so that said chest becomes fixed relative to the collar and the marine hull in a position that allows said chest to draw a high flow of sea water for marine engine cooling and other purposes, and whereby said orifice is also connected for periodically introducing strong bursts into said hollow interior to clean it of clogs and debris that would otherwise accumulate and reduce the free flow of seawater into said inlet opening means.

2. The sea chest of claim 1 wherein said fastener means comprises a plurality of sturdy bolts.

3. The sea chest of claim 2 wherein said bolts are oversized and sufficiently closely spaced apart to increase sea chest longevity.

4. The sea chest of claim 1 wherein said activation means is selected from a group consisting of manual activation means that are voluntarily operated and automated activation means that are operated in response to a predetermined amount of change in monitored data.

5. The sea chest of claim 1 wherein said inlet opening means through said top surface comprises two spaced-apart circular openings each positioned above said wider end of said keyhole-shaped opening.

6. The sea chest of claim 1 wherein said outside edges have an inwardly sloping configuration.

7. The sea chest of claim 1 wherein said wider end of said keyhole-shaped opening has an inside edge with a sloping configuration.

8. A sea chest that can be flush-mounted through use of a collar within a recessed opening in the hull of a marine vessel below its waterline to provide a large volume of water substantially without drag or cavitation for cooling the inboard engines of the marine vessel, said sea chest comprising:

a chest with a substantially hollow interior, a bottom surface with a perimeter, and an opposing top surface;

a keyhole-shaped opening through said bottom surface, said keyhole-shaped opening having a wider end and being configured with outside edges that cause eddys to form and seawater to flow into said hollow interior at the center portion of said outside edges;

a plurality of recessed apertures through said bottom surface adjacent to said perimeter;

at least one inlet opening through said top surface that leads to the inlet side of the marine engines requiring cooling;

an purge orifice through said top surface;

activation means adapted for sending a quick purging burst of fluid from said purge orifice and through said hollow interior to clean debris clogging said chest and eliminate the need for manual cleaning thereof; and a plurality of sturdy bolts each configured for partial insertion through a different one of said recessed apertures for secure connection of said bottom surface of said chest to the marine hull in a flush-mounted position and also through fastener openings in a collar on the inside of the hull that correspond in positioning to said recessed openings through said bottom surface, so that said chest becomes fixed relative to the collar and the marine hull in a position that allows said chest to draw a high flow of sea water for marine engine cooling and other purposes and whereby said purge orifice is also connected for periodically introducing strong bursts into said hollow interior to clean it of clogs and debris that would otherwise accumulate and reduce the free flow of seawater into said at least one inlet opening.

9. The sea chest of claim 8 wherein said bolts oversized.

10. The sea chest of claim 8 wherein said bolts have a close spaced-apart positioning.

11. The sea chest of claim 8 wherein said activation means is selected from a group consisting of manual activation means that are voluntarily operated and automated activation means that are operated in response to a predetermined amount of change in monitored data.

12. The sea chest of claim 8 wherein said at least one inlet opening through said top surface comprises two spaced-apart circular openings each positioned above said wider end of said opening.

13. The sea chest of claim 8 wherein said outside edges have an inwardly sloping configuration.

14. The sea chest of claim 8 wherein said wider end of said keyhole-shaped opening has an inside edge with a sloping configuration.

15. A method of making a sea chest that can provide a large volume of seawater substantially without drag or cavitation for cooling the inboard engines of a marine vessel, said method comprising the steps of:

providing a chest having a bottom surface with a keyhole-shaped opening the narrow end of which must be positioned as a leading edge, an opposing top surface, a hollow interior, an orifice through which a quick purging burst of fluid can be sent, at least one inlet opening leading to the inlet side of seawater pumps, and a plurality of recessed fastener openings positioned about its perimeter;

also providing a collar having a substantially centered large opening therethrough that corresponds in configuration and is slightly larger than said top surface of said chest, and a plurality of fastener openings identical in size and positioning to said recessed fastener openings through said chest;

further providing a plurality of sturdy fasteners, a quantity of waterproof sealant, a drill, and a marine vessel with a hull having a recessed opening therethrough below the water line that is slightly larger than said bottom surface, the recessed opening being configured for flush mounting of said bottom surface;

from the outside of said hull, aligning said chest with said recessed opening in said marine hull so that said keyhole-shaped opening is exposed to the seawater;

moving said chest into said recessed opening in said hull until said keyhole-shaped opening is in a position flush with said outside surface of said hull and said narrow end of said keyhole-shaped opening is proximal to the front end of the marine vessel;

optionally applying said sealant to said recessed opening in said hull and the area of the inside of said hull immediately adjacent to said recessed hull opening;

from the inside of said hull, aligning said large opening in said collar with said top surface of said chest;

moving said collar toward the inside of said hull until said collar contacts said hull;

using said drill to form holes through the recessed portion of said opening in said hull that correspond in spacing to said openings in said collar and said recessed openings in said chest;

inserting one of said sturdy fasteners through a different one of said openings in said bottom surface, and the openings in said hull and said collar aligned therewith;

connecting said orifice so that a burst of fluid can enter said chest via said orifice; and securing each of said fasteners against said bottom surface and said collar so that as said hull is moved forwardly through seawater by its inboard marine engines, said narrow end of said keyhole-shaped opening causes eddys to form at said outside edges and seawater to flow into said chest at the center of said outside edges to create a large volume of water directed toward each said inlet opening in said top surface that leads to the inlet side of seawater pumps for use in cooling the marine engines without cavitation, and so that periodic bursts can be introduced via said orifice into said hollow interior to clean it of clogs and debris that would otherwise accumulate and reduce the free flow of seawater into said at least one inlet opening.

16. The method of claim 15 wherein said bolts have an oversized configuration and said recessed fastener openings in said chest are closely spaced apart.

17. The method of claim 15 wherein said step of connecting said orifice is selected from a group consisting of the step of connecting said orifice to a manual activation means that can be voluntarily operated and the step of connecting said orifice to an automated activation means that can be operated in response to a predetermined amount of change in monitored data.

18. The method of claim 15 wherein said chest comprises two spaced-apart circular inlet openings each positioned above said wider end of said keyhole-shaped opening.

19. The method of claim 15 wherein said outside edges have an inwardly sloping configuration.

20. The method of claim 15 wherein said wider end of said keyhole-shaped opening has an inside edge with a sloping configuration.

* * * * *